US006405719B2

(12) United States Patent
Nozato

(10) Patent No.: US 6,405,719 B2
(45) Date of Patent: Jun. 18, 2002

(54) DEVICE FOR SUPPRESSING BLACK SMOKE EMISSION

(76) Inventor: Kiyoshi Nozato, 8-6, Noe 2-chome, Joto-ku, Osaka (JP)

( * ) Notice: Subject to any disclaimer, the term of this patent is extended or adjusted under 35 U.S.C. 154(b) by 0 days.

(21) Appl. No.: 09/837,025

(22) Filed: Apr. 18, 2001

(30) Foreign Application Priority Data

Apr. 19, 2000 (JP) ..... 2000-117392

(51) Int. Cl.[7] ..... F23K 5/00
(52) U.S. Cl. ..... 123/538
(58) Field of Search ..... 123/538, 536, 123/537

(56) References Cited

U.S. PATENT DOCUMENTS 3,597,668 A * 8/1971 Yoshimine ..... 123/538
4,414,951 A * 11/1983 Saneto ..... 123/538
4,798,191 A * 1/1989 King ..... 123/538
6,167,871 B1 * 1/2001 Kumagai et al. ..... 123/538
6,183,700 B1 * 2/2001 Jeong ..... 123/538

* cited by examiner

*Primary Examiner*—Marguerite McMahon
(74) *Attorney, Agent, or Firm*—Webb Ziesenheim Logsdon Orkin & Hanson, P.C.

(57) ABSTRACT

A black smoke emission suppressing device for suppressing generation of black smoke in combustion of a liquid fuel includes: a vessel having a cylindrical casing formed with a fuel inflow opening in a center of an end thereof and a fuel outflow opening in a periphery thereof, and a supply cylinder member arranged in the cylindrical casing, the supply cylinder member having one end being opened, the other end being closed, and a plurality of through holes in a periphery thereof, the opened end being connected with the fuel inflow opening of the cylindrical casing to thereby allowing the liquid fuel to flow in the supply cylinder member; and an electrostatic charger having a charging cylinder coaxially placed on an outer periphery of the supply cylinder member, the charging cylinder being formed with a plurality of spiral channels extending in radial directions, inner openings of the plurality of spiral channels being respectively connected with the plurality of through holes of the supply cylinder member to thereby allow the liquid fuel to flow in the plurality of spiral channels and then flow out from outer openings of the plurality of spiral channels.

8 Claims, 8 Drawing Sheets

DEVICE FOR SUPPRESSING BLACK SMOKE EMISSION

BACKGROUND OF THE INVENTION

1. Field of the Invention

This invention relates to a black smoke emission suppressing device for reducing the amount of black smoke which is caused by burning liquid fuel such as gasoline and light oil used as a power source for an internal combustion engine or the like.

2. Description of the Prior Art

There has been known, as disclosed in Japanese Unexamined Utility Model Publication No. 58-40244, a device for removing sludge in fuel oil. In the device, sludge in fuel oil such as gasoline and light oil is removed by flowing the fuel oil through magnets disposed in a fuel flowing channel of the device and removing the sludge together with ferrous objects in the fuel oil by using magnetic attraction force of the magnets. The publication recites that combustion efficiency is improved when fuel oil which has undergone the aforementioned process is used as fuel for an internal combustion engine. The publication also recites that reduction of black smoke emission due to reduction of sludge is expected.

The aforementioned sludge removing device contributes to improvement of fuel cost performance and black smoke emission reduction to some extent. However, there has been a demand for a device which ensures further improved combustion efficiency and cost performance.

In addition to the above conventional device, there have been developed various devices including a device of removing sludge by subjecting fuel oil to filtration prior to supplying the fuel oil to a combustion chamber, and a device of reformating fuel oil into reformated oil having high combustion performance by using a variety of catalysts. The ones using filtration system cannot provide improved combustion efficiency although they suppress the amount of black smoke emission due to sludge removal. On the other hand, the ones using catalysts have not been widely used because the catalysts are expensive.

SUMMARY OF THE INVENTION

It is an object of the present invention to provide a black smoke emission suppressing device which is free from the aforementioned problems residing in the prior art.

According to an aspect of the invention, a black smoke emission suppressing device is adapted for suppressing black smoke in burning of a liquid fuel. The device comprises a vessel for allowing a liquid fuel to flow therethrough and an electrostatic charger for electrostatically charging the liquid fuel.

The black smoke emission suppressing device considerably reduces the amount of black smoke which accompanies burning of such liquid fuel as gasoline and light oil used in an internal combustion engine or the like, and thus contributes to fuel cost reduction.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
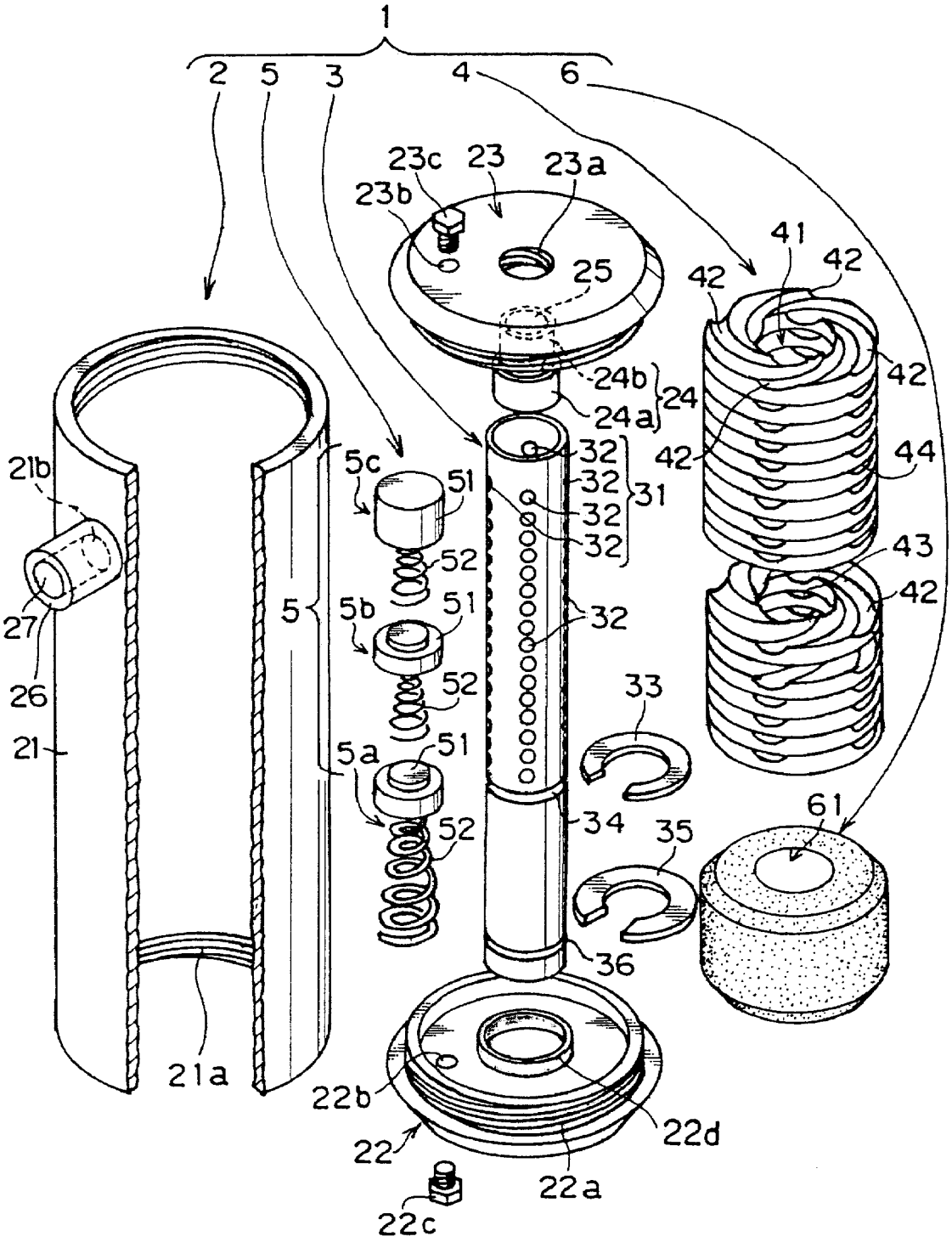
FIG. 1 is an explosive perspective view of a black smoke emission suppressing device as a first embodiment according to this invention.
Figure 2:
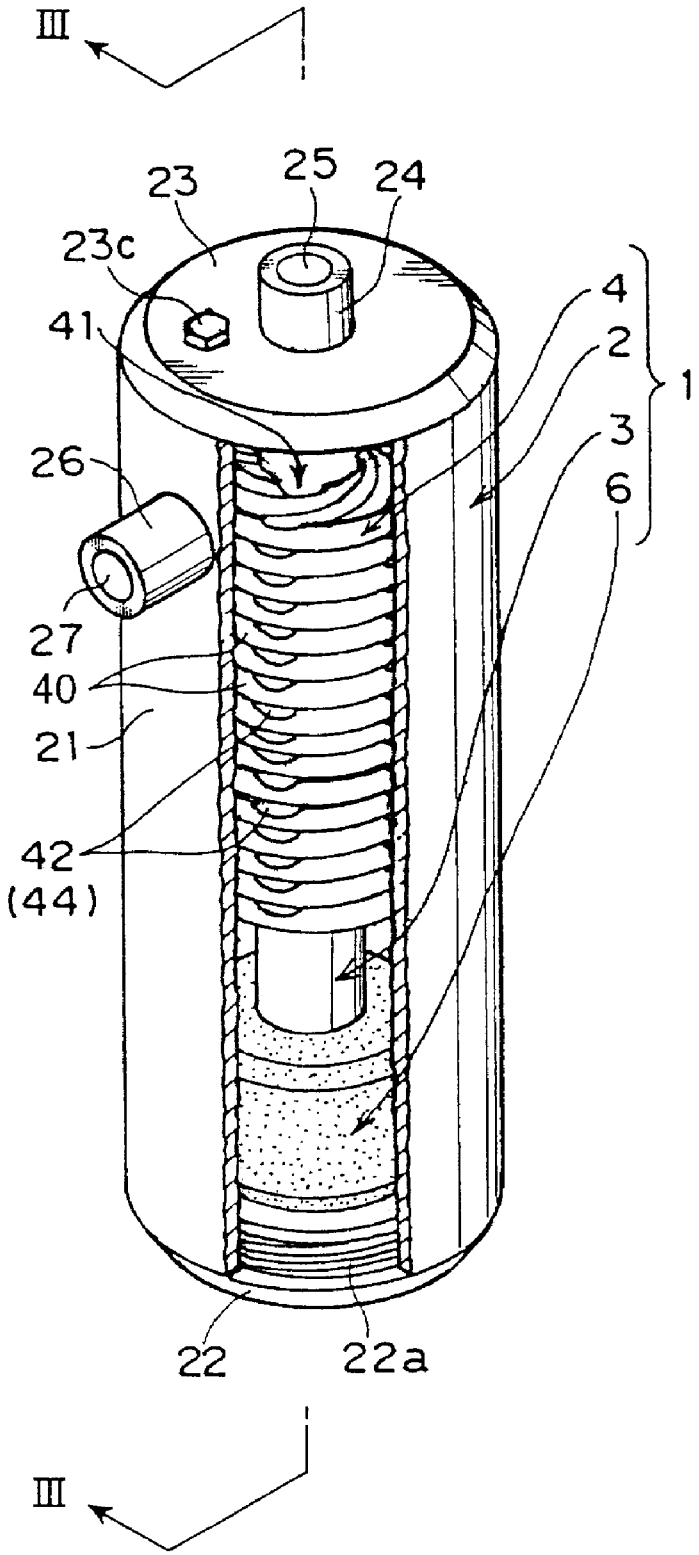
FIG. 2 is a partially cut away perspective view of the device in an assembled state.
Figure 3:
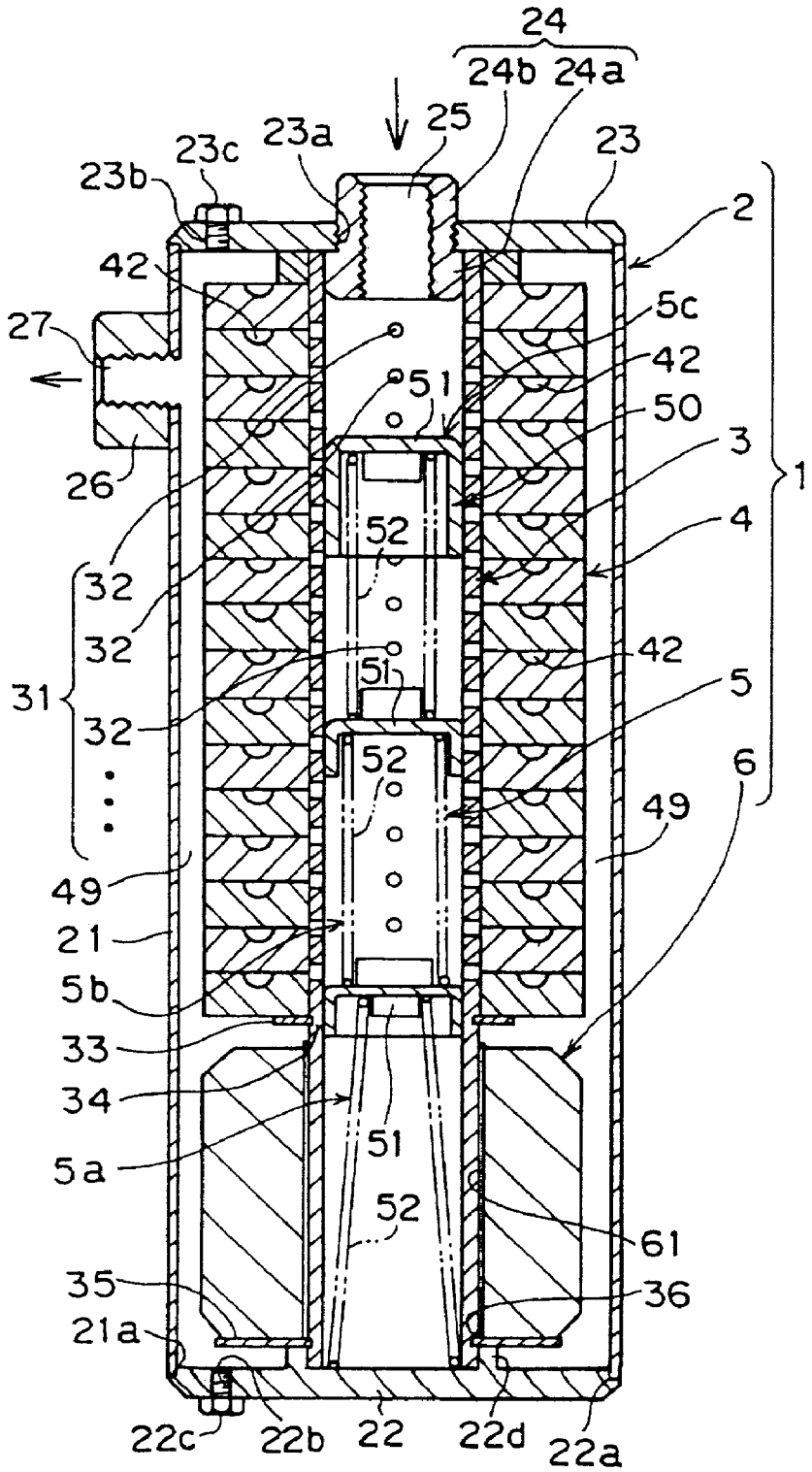
FIG. 3 is a sectional view of the device taken along the line III—III in FIG. 2.

A first embodiment of this invention is described with reference to FIGS. 1 to 4. As shown in FIGS. 1 to 3, a black smoke emission suppressing device 1 includes a metallic cylindrical casing 2, a metallic supply cylinder member 3 which is disposed inside the cylindrical casing 2, an electrostatic charger 4 which is brought into fit contact over the supply cylinder member 3, a piston member 5 which is slidably movable in the supply cylinder member 3, and a pulsation absorber 6 which is disposed inside the cylindrical casing 2.

As shown in FIG. 1, the cylindrical casing 2 has a hollow tubular main body 21, a bottom member 22 which closes a bottom space of the main body 21, and a top member 23 which closes a top space of the main body 21. The cylindrical casing 2 is formed with an internal threaded portion 21*a* in an inner surface of a bottom part thereof. The bottom member 22 is formed with an external threaded portion 22*a* at a part corresponding to the internal threaded portion 21*a* of the cylindrical casing 2. Screwing the external threaded portion 22*a* of the bottom member 22 in the internal threaded portion 21*a* of the cylindrical casing 2 fixes the bottom member 22 to the main body 21 of the cylindrical casing 2.

As shown in FIG. 1, the bottom member 22 is formed with a through discharge hole 22*b* with an internal thread formed in an inner surface thereof. A screw plug 22*c* which detachably plugs in the hole 22*b* is provided. The drainage hole 22*b* is adapted to discharge residue of fuel which stays at the bottom part of the main body 21, and is closed by the plug 22*c* when the device 1 is in use.

The top member 23 is formed with a screw hole 23*a* at a center thereof. A first nipple 24 is provided at the bottom side of the top member 23 at the position corresponding to the screw hole 23*a*. The first nipple 24 has a head 24*a* which has a larger diameter than the screw hole 23*a*, and a stem 24*b* which concentrically extends from the head 24*a*. The stem 24*b* has a smaller diameter than the head 24*a* and has the same diameter as the screw hole 23*a*. An external thread corresponding to an internal thread of the screw hole 23*a* is formed in a base end of the stem 24*b*. Screwing the external thread of the stem 24*b* into the internal thread of the screw hole 23*a* fixes the first nipple 24 to the top member 23. As shown in FIG. 2, a hole 25 formed in the center of the first nipple 24 constitutes a fuel inflow opening for introducing liquid fuel inside the device 1.

An air inlet hole 23*b* is formed at an appropriate position in the top member 23. The air inlet hole 23*b* is formed with an internal thread in an inner surface thereof. The air inlet hole 23*b* is closed by a screw plug 23*c* when the device 1 is in use, and is opened when the drainage hole 22*b* of the bottom member 22 is opened.

The top member 23 is formed with an external thread along an outer periphery thereof. The cylindrical casing 2 is formed with an internal thread along an upper end inner surface thereof at a position corresponding to the external thread of the top member 23. Screwing the external thread of the top member 23 in the internal thread of the cylindrical casing 2 fixedly mounts the top member 23 on the cylindrical casing 2.

A hole 21*b* for discharging liquid fuel outside is formed at an appropriate position in the tubular main body 21. A second nipple 26 is fixed to the tubular main body 21 in such a manner that the second nipple 26 encloses the hole 21*b*. The second nipple 26 is formed with an external thread in an outer surface thereof, and is formed with a center outlet hole 27 for discharging the liquid fuel outside.

The supply cylinder member 3 has an inner diameter which is generally identical to or slightly larger than the outer diameter of the head 24*a* of the first nipple 24. The supply cylinder member 3 is concentrically fitted in the cylindrical casing 2 in a state that an upper end of the supply cylinder member 3 is covered by the head 24*a* of the first nipple 24.

A lower end of the supply cylinder member 3 comes into fit contact with the upper surface of the bottom member 22. Specifically, an annular projection 22*d* having an inner diameter generally identical to or slightly larger than the outer diameter of the supply cylinder member 3 is formed on the upper surface of the bottom member 22. Fitting the lower end of the supply cylinder member 3 along an inner wall of the annular projection 22*d* fixedly mounts the supply cylinder member 3 in the cylindrical casing 2.

As shown in FIG. 1, a set of four through holes (fuel passing holes) 32 are circumferentially equidistantly formed along an outer periphery of the supply cylinder member 3 at an interval of 90° . A plurality of sets of these through holes 32 are formed at a certain interval in an axial direction of the supply cylinder member 3 in a region from a height level of about ⅓ from the bottom of the supply cylinder member 3 up to a certain position on the upper part thereof. The plurality of sets of through holes 32 constitute a hole group 31. Liquid fuel which has been introduced into the supply cylinder member 3 through the inlet hole 25 flows through the fuel passing holes 32, and is discharged out of the device 1 through the outlet hole 27 via the electrostatic charger 4 and inside the tubular main body 21 of the cylindrical casing 2.

The electrostatic charger 4 in the first embodiment comprises a charging cylinder including a number of disc members 40, which are stacked in the axial direction of the supply cylinder member 3 one over another. Each of the disc members 40 is formed with a center hole 41. Each of the disc members 40 has an inner diameter (namely, the diameter of the center hole 41) slightly larger than the outer diameter of the supply cylinder member 3 and has an outer diameter slightly smaller than the inner diameter of the main body 21 of the cylindrical casing 2. The disc members 40 of the electrostatic charger 4 are fitted over the inner cylinder member 3, and the inner cylinder member 3 which has been mounted with the stacked disc members 40 is fitted inside the cylindrical casing 3.

Figure 4:
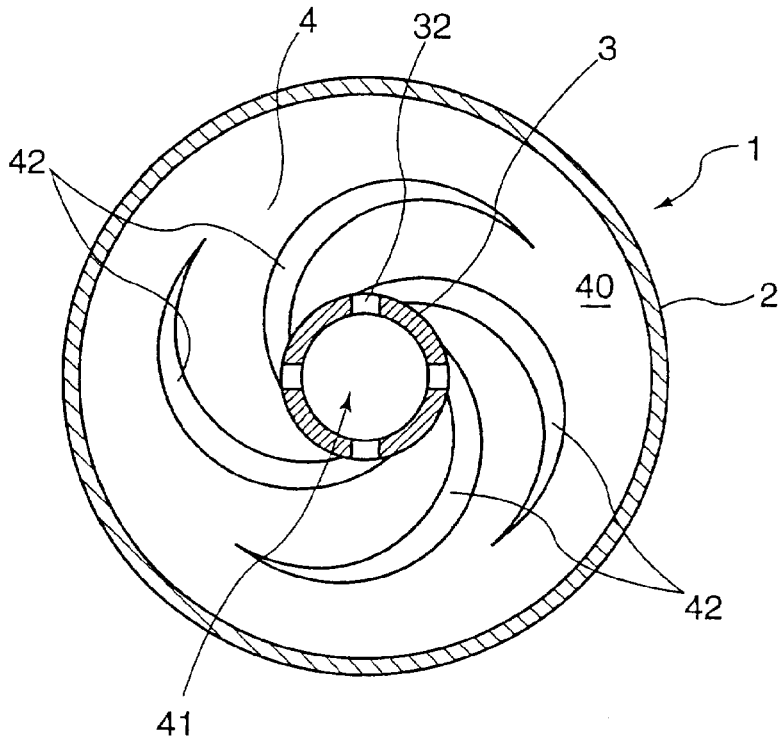
FIG. 4 is a sectional plan view of the device.

The outer surface of the disc members 40 and the inner surface of the main body 21 of the cylindrical casing 2 define an annular channel 49 as shown in FIGS. 3 and 4 when the supply cylinder member 3 mounted with the vertically stacked disc members 40 is fitted inside the main body 21 of the cylindrical casing 2. The annular channel 49 facilitates flow of the liquid fuel inside the cylindrical casing 2.

FIG. 4 is a sectional plan view of the black smoke emission suppressing device 1. As shown in FIG. 4, each of the disc members 40 is formed with four spiral grooves or channels 42 on the top surface thereof. The spiral grooves 42 in the disc member 40 are formed radially apart from each other equidistantly. Each of the spiral grooves 42 extend radially outwardly from the center hole 41 toward a radial distal end. The thickness of the disc member 40 is so set as to oppose an opening, i.e., an inlet port 43, of each of the spiral grooves 42 which is opened radially inwardly toward the center hole 41 to the corresponding fuel passing hole 32 of the supply cylinder member 3 when the disc members 40 are stacked one over another around the supply cylinder member 3. The liquid fuel which flows out of the supply cylinder member 3 through the fuel passing holes 32 is temporarily guided to the annular channel 49 via openings, i.e., outlet ports 44, which are formed in a radially outward distal end of each of the disc members 40 after flowing along the corresponding spiral grooves 42. The liquid fuel is then discharged out of the device 1 via the outlet hole 27 of the cylindrical casing 2.

The disc members 40 constituting the electrostatic charger 4 are made of a material which causes the liquid fuel to be positively charged while flowing in friction contact with the spiral channels 42. Preferably, the material may be a synthetic resin made of olefins such as polyethylene and polypropylene. The material is not limited to a synthetic resin of olefin, and various materials may be applicable as far as the material makes liquid fuel electrostatically charged due to frictional contact.

As shown in FIG. 1, an upper ring fitting groove 34 is formed in the supply cylinder member 3 at a position slightly below the bottommost set of fuel passing holes 32 to fit an upper C-shaped ring 33. Fitting the upper C-shaped ring 33 in the upper ring fitting groove 34 and mounting the electrostatic charger 4 on the supply cylinder member 3 keeps the generator 4 from slipping out of the supply cylinder member 3.

The piston member 5 is mounted inside the inner cylinder member 3. In this embodiment, the piston member 5 includes a lower piston member 5*a*, a middle piston member 5*b*, and an upper piston member 5*c*. The piston member 5*a* (5*b* or 5*c*) includes a piston 51 which is slidably fitted inside the inner surface of the supply cylinder member 3, and a helical spring 52 which is attached to a bottom part of the piston 51. The helical spring 52 has a gradually reduced radial size as oriented upward.

The piston member 5 is constructed in such a manner that the upper piston member 5*c* is mounted over the middle piston member 5*b*, and the middle piston member 5*b* is mounted over the lower piston member 5*a* inside the inner cylinder member 3. Thus, the three piston members are stacked one over another inside the supply cylinder member 3. As shown in FIG. 3, the piston 51 of the upper piston member 5*c* closes the fourth from the uppermost set of fuel passing holes 32 and the sets lower than the fourth set when liquid fuel is not introduced into the supply cylinder member 3. As the liquid fuel is supplied inside the supply cylinder member 3 through the inlet hole 25, a liquid pressure is exerted to the piston 51 of the upper piston member 5*c*, which resultantly lowers the upper piston member 5*c* against the biasing force of the helical spring 52. As a result of lowering, the number of fuel passing holes 32 which are located above the piston 51 of the upper piston member 5*c* increases compared to the state when the liquid fuel has not been supplied into the supply cylinder member 3.

Pressing force against the piston increases in proportion to the flowing rate of liquid fuel. Accordingly, as the flowing rate increases, the lowering amount of the piston 51 of the uppermost piston member increases. As the lowering amount increases, the number of the fuel passing holes 32 above the piston 51 of the uppermost piston member increases to allow a larger amount of fuel to pass through these upper located fuel passing holes 32. The height level of the piston 51 of the uppermost piston member is set in such a manner that the pressure of the liquid fuel exerted to the piston 51 is balanced with the biasing forces of the helical springs 52 of the three piston members 5*a*, 5*b*, 5*c*.

The number of piston members may be other than three. Namely, two or less, or four or more piston members may be provided.

The pulsation absorber 6 is adapted to eliminate a fluctuation in fluid pressure of the liquid fuel which may likely to occur when the liquid fuel is kept being supplied into the device 1 during an extended time period. The pulsation absorber 6 in this embodiment is made of a resilient urethane foam.

The pulsation absorber 6 has an outer diameter slightly smaller than the inner diameter of the main body 21 of the cylindrical casing 2, and is formed with a fitting hole 61 having a diameter identical to the outer diameter of the supply cylinder member 3. Inserting the lower part of the inner cylinder member 3 in the fitting hole 61 fixedly supports the supply cylinder member 3 in the pulsation absorber 6.

An annular lower ring fitting groove 36 is formed in a lower part of the outer periphery of the supply cylinder member 3, as shown in FIG. 1. Fitting a lower C-shaped ring 35 in the lower ring fitting groove 36 and mounting the supply cylinder member 3 in the fitting hole 61 of the pulsation absorber 6 keeps the pulsation absorber 6 from slipping out of the inner cylinder member 3.

In the following section, an operation of the device 1 is described primarily with reference to FIG. 3 and along with the other drawings according to needs. As shown in FIG. 3, when the liquid fuel is supplied into the black smoke emission suppressing device 1 through the inlet hole 25, the liquid fuel is first drawn inside the supply cylinder member 3, and is drawn out of the supply cylinder member 3 through the fuel passing holes 32. As the fuel is drawn out of the supply cylinder member 3, the flowing fuel presses against the piston 51 of the upper piston member 5*c*. The liquid fuel is then guided along the spiral grooves 42 of the corresponding disc members 40 which opposes the corresponding fuel passing holes 32. While the liquid fuel flows along the spiral grooves 42, the liquid fuel is charged with positive electricity due to friction contact with the spiral grooves 42 of the electrostatic charger 4.

The positively charged liquid fuel is collected to the annular channel 49 which is defined by the tubular main body 21 of the cylindrical casing 2 and the supply cylinder member 3. The fuel is then supplied to a combustion unit such as an internal combustion engine by way of the outlet hole 27.

As mentioned above, the liquid fuel to be supplied to the combustion unit is positively charged. Accordingly, the diameter of fuel particles becomes extremely small when ejected through a combustion nozzle into a combustion chamber of the combustion unit because charged fine particles repulse against each other. As a result of repulsion, the distance between particles is widened.

To summarize the above, the total surface area of liquid fuel particles remarkably increases compared to the case where the fuel is supplied in a normal liquid state without passing through the electrostatic charger 4 because the fuel is supplied in fine particulate state owing to the electrostatically charge. Further, the widened distance between fine particles contributes to active contact of fuel particles with oxygen in the air. These factors in combination allows the electrostatically charged liquid fuel to perform complete combustion. As a result, compared to the conventional device, this device raises combustion efficiency and reduces the amount of black smoke which is emitted as exhaust gas during combustion.

Figure 5:
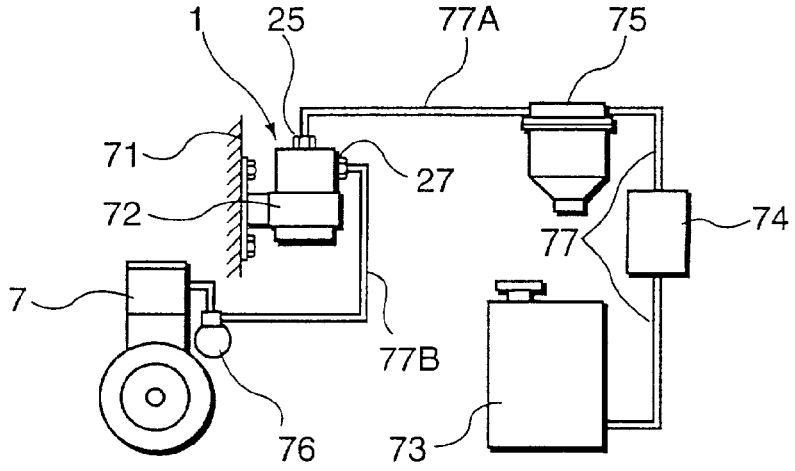
FIG. 5 is a diagram illustrating an example as to how the device is used.

FIG. 5 is a diagram illustrating an example as to how the black smoke emission suppressing device 1 is used. This example shows a case that the device 1 is used in association with a diesel engine 7. As shown in FIG. 5, the device 1 is attached to a frame 71 of an engine room by a bracket 72. A fuel tank 73, a fuel supply pump 74, a filter 75, the device 1, a fuel sparger pump 76, and the diesel engine 7 are connected by a fuel pipe 77 in this order from upstream toward downstream in a fuel supply direction. The device 1 is disposed on the fuel pipe 77 between the filter 75 and the fuel sparger pump 76.

The fuel supply pipe system 77 has an upstream section 77A provided upstream in the fuel supply direction with respect to the device 1, and a downstream section 77B provided downstream with respect to the device 1.

A lead end of the upstream section 77A is connected to the inlet hole 25 of the device 1, and a tail end of the downstream section 77B is connected to the outlet hole 27 of the device 1. With this arrangement, the liquid fuel in the fuel tank 73 is supplied downstream by driving of the fuel supply pump 74 to the filter 75 where the fuel is subjected to filtration. The filtrated fuel is charged with a static electricity while being supplied through the device 1, and supplied to the diesel engine 7 by the fuel sparger pump 76.

The liquid fuel is atomized into particles by the fuel sparger pump 76 and the particles are positively charged. Accordingly, the particles are further brought into finer particles by repulsion and dispersion of the particles. As a result, the finer particles are uniformly diffused in the diesel engine 7, which contributes to complete combustion in the diesel engine 7 and realizes black smoke emission suppression and fuel cost reduction.

Figure 6:
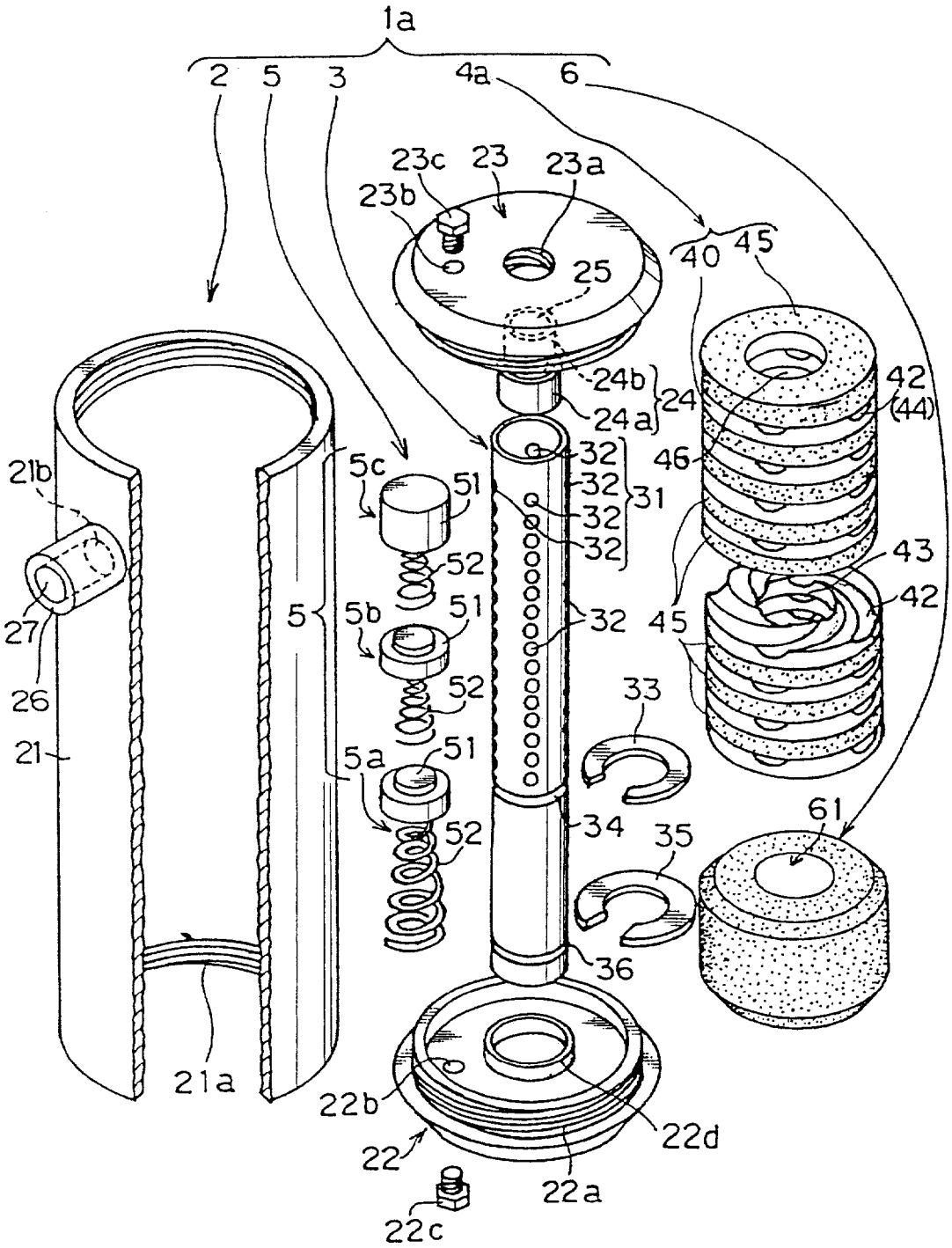
FIG. 6 is an explosive perspective view of a black smoke emission suppressing device as a second embodiment according to this invention.
Figure 7:
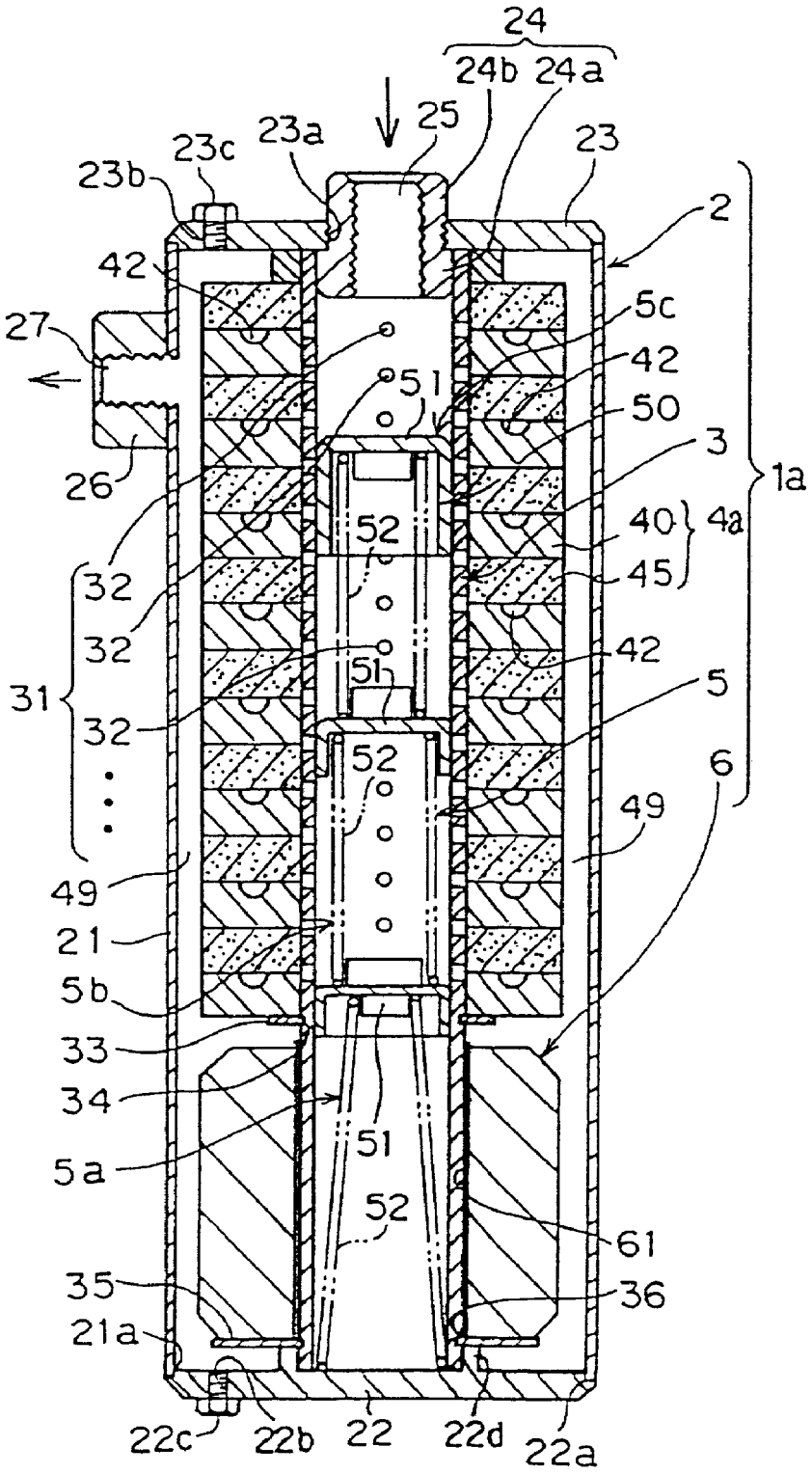
FIG. 7 is a vertical sectional view of the device shown in FIG. 6 in an assembled state.

A second embodiment according to this invention is described with reference to FIGS. 6 and 7. As shown in FIGS. 6 and 7, a black smoke emission suppressing device 1*a* has the same construction as the device 1 in the first embodiment in the point that the device 1*a* has an cylindrical casing 2, an supply cylinder member 3, a piston member 5, and a pulsation absorber 6. It should be appreciated that elements in the second embodiment which are identical to those in the first embodiment are denoted at the same reference numerals as the first embodiment. The device 1*a* is different from the device 1 in that an electrostatic charger 4*a* in the device 1*a* has a plurality of disc members 40 (shown by hatched portions in FIG. 7) and annular magnets 45 (shown by hatched and dotted portions in FIG. 7).

More specifically, in the second embodiment, the electrostatic charger 4*a* is constructed in such a manner that the disc members 40 and the annular magnets 45 are stacked alternately. Since the disc members 40 in the second embodiment are the same as those in the first embodiment, the description thereof is omitted herein. The annular magnet 45 has the outer diameter and the thickness identical to those of the disc member 40. The annular magnet 45 is formed with a center hole 46, and has an inner diameter identical to the inner diameter of the disc member 40.

The disc members 40 and the magnets 45 are alternately stacked on the supply cylinder member 3 to constitute the electrostatic charger 4*a*. The annular magnets 45 are stacked in such a manner that the upper magnet and the lower magnet with respect to the interposed disc member 40 have the opposite polarities, i.e., north pole and south pole, on their opposite surfaces.

With this arrangement, liquid fuel supplied inside the supply cylinder member 3 through the inlet hole 25 is drawn out of the supply cylinder member 3 through the fuel passing holes 32 and guided along the spiral grooves 42 of the disc members 40. While passing along the spiral grooves 42, the fuel is electrostatically charged. Simultaneously, the respective sets of upper and lower magnets 45 which sandwich the corresponding disc members 40 give magnetic force to the flowing charged liquid fuel, which is further effective in suppressing black smoke emission in exhaust gas.

The advantageous effect of magnetic force for suppression of black smoke emission is conceivably described as follows. Liquid fuel is electrostatically charged while passing through the spiral grooves 42 of the disc members 40. The magnetic force applied to the flowing charged liquid fuel causes fragmentation of molecules in the liquid fuel into finer particles, thereby contributing to improvement of combustion efficiency and suppression of black smoke emission.

EXAMPLES

To verify the effects of these inventive devices, the following experiments were carried out. In Inventive Example, measured was travel distance of a truck loaded with a diesel engine per litter of light oil which has undergone the process by the inventive device 1. As comparative examples, measured were travel distances of the same truck loaded with the diesel engine per litter of light oil which has not undergone the process by the device 1 (Comparative Example 1) and per litter of light oil which has undergone the process by the conventional device employing magnets (Comparative Example 2). It should be noted that in Comparative Example 2, light oil was not passed through the combination of magnets and disc members, but was passed through magnets solely.

The experiments used a truck loadable with 4 tons of goods or commodity to transport the same for a long distance every day. The truck ran in a fully loaded state in the experiments. The replenish amount of light oil and travel distance of the truck were recorded per day, and the data was collected per month. The travel distance per litter (km/l) was calculated per month by dividing the total travel distance in a month by the total amount of replenished oil in the month.

Figure 8:
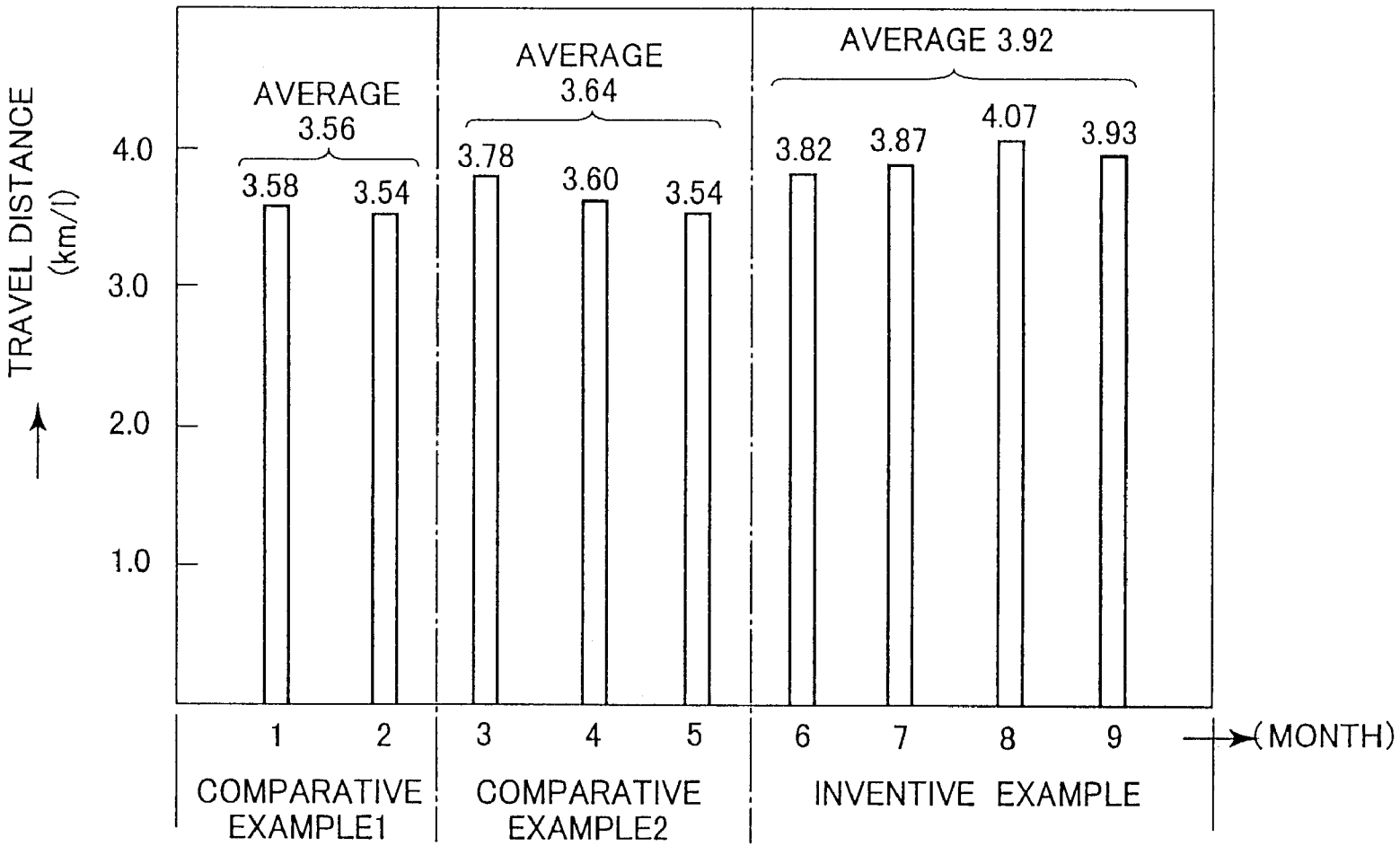
FIG. 8 is a graph showing results of combustion efficiency of comparative examples and an example of this invention.

The result of the experiments is shown in the graph of FIG. 8. As is obvious from the graph, in Comparative Example 1 where no treatment was performed for the fuel oil, the travel distance per litter was 3.56 (km/l) by taking the average of two consecutive months. In Comparative Example 2 where the fuel oil was treated with the conventional device employing magnets, the travel distance per litter was 3.64 (km/l) by taking the average of three consecutive months, which was slightly improved compared to Comparative Example 1.

On the other hand, in Inventive Example where light oil was treated with the inventive device 1, the travel distance per litter was 3.92 (km/l) by taking the average of four consecutive months, which has a remarkably good result compared to Comparative Examples 1 and 2. The distance in Inventive Example was increased by 10% compared to Comparative Example 1, and 8% compared to Comparative Example 2. The result shows that the device 1 is effective in fuel cost performance. Concerning to black smoke emission, it was confirmed that emission in Inventive Example was visibly lessened compared to Comparative Examples 1 and 2.

Figure 9:
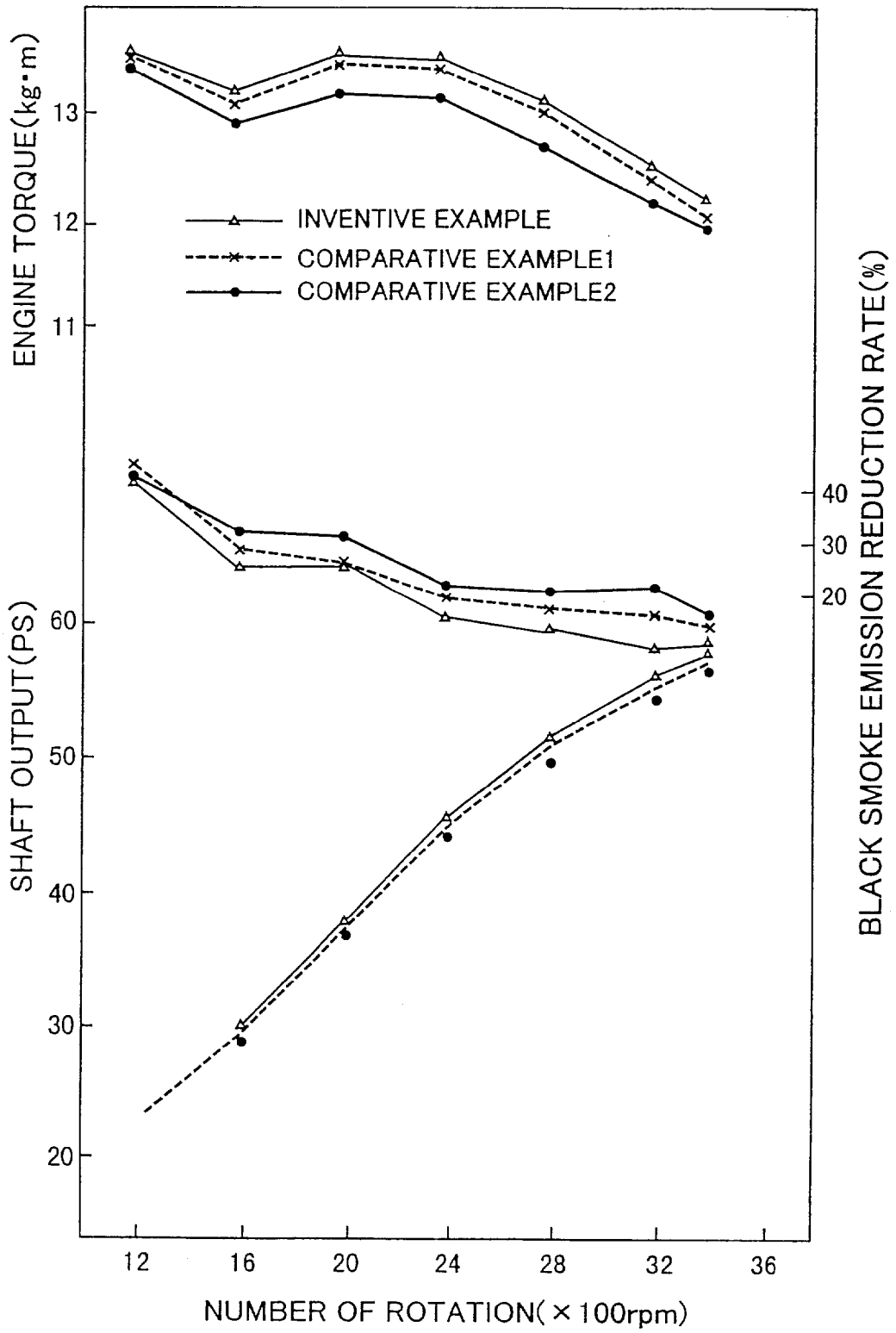
FIG. 9 is a graph showing measurement results of engine torque, black smoke emission reduction rate, and shaft output relative to the number of rotations of a diesel engine when light oil is used as fuel in comparative examples and an example of this invention.

Next, engine torque (unit: kg·m), black smoke emission reduction rate (%), and shaft output (unit: PS) relative to the number of rotations of engine (unit: rpm) were measured when a diesel engine was driven with use of the light oil treated with the inventive device 1. Similarly, performance of the diesel engine was examined with respect to the same parameters when the diesel engine was driven with use of the light oils in Comparative Examples 1 and 2. FIG. 9 is a graph showing the measurement results of the respective examples.

It should be noted that the black smoke emission reduction rate in FIG. 9 is represented in terms of percentage of the emission amount (X) of black smoke when the diesel engine was driven in a normal running state based on the emission amount (Y) of black smoke when the diesel engine was set in an idling state, that is, $=X/Y\times100$.

As shown in the graph of FIG. 9, it was verified that the light oil treated with the inventive device 1 exhibits superior results in terms of engine torque, black smoke emission reduction rate, and shaft output compared to Comparative Examples 1 and 2.

As described above, an inventive black smoke emission suppressing device is used to suppress generation of black smoke in combustion of a liquid fuel. The device is provided with a vessel for allowing a liquid fuel to flow therethrough, and an electrostatic charger for electrostatically charging the liquid fuel.

With this construction, liquid fuel having been passed through the electrostatic charger carries an electrostatic electricity. Supplying thus electrostatically charged liquid fuel through a sparger or the like to burn the fuel in a combustion chamber enables to bring the liquid fuel into fine particles having a smaller diameter owing to electric repulsion force of fine particles charged with the same electricity (namely, negative or positive). As a result, a total surface area of liquid fuel particles remarkably increases, and fuel particles are widely and uniformly diffused by the electric repulsion force between fine particles. The liquid fuel particles are actively brought into contact with oxygen in the air, and more idealistic combustion is realized. As a result, the amount of black smoke in exhaust gas after burning the fuel is reduced, and combustion efficiency is improved.

The vessel may be constructed by a cylindrical casing formed with a fuel inflow opening in a center of an end thereof and a fuel outflow opening in a periphery thereof, and a supply cylinder member arranged in the cylindrical casing. The supply cylinder member has one end being opened, the other end being closed, and a plurality of through holes in a periphery thereof. The opened end is connected with the fuel inflow opening of the cylindrical casing to thereby allow the liquid fuel to flow in the supply cylinder member. The electrostatic charger may be provided with a charging cylinder coaxially placed on an outer periphery of the supply cylinder member. The charging cylinder is formed with a plurality of spiral channels extending in radial directions, inner openings of the plurality of spiral channels being respectively connected with the plurality of through holes of the supply cylinder member to thereby allow the liquid fuel to flow in the plurality of spiral channels and then flow out from outer openings of the plurality of spiral channels.

With this arrangement, the liquid fuel is supplied into the supply cylinder member, and flowed from the supply cylinder member into the plurality of spiral channels of the charging cylinder through the plurality of through holes of the supply cylinder member. The liquid fuel is flowed out of the outer openings of the charging cylinder. The liquid fuel is electrostatically charged due to frictional contact with the inner surface of each spiral channel of the charging cylinder. The charged liquid fuel is discharged through the fuel outflow opening of the cylindrical casing.

The spiral channels in the charging cylinder allow the liquid fuel to flow in an extended passage, thereby enhancing electrostatic charging of the liquid fuel.

The spiral channels may be formed by stacking a plurality of disc members each formed with a spiral groove one over another.

The electrostatic charger may be further provided with a plurality of annular magnets placed between one disk member and another disk member.

With this arrangement, the disc members and the annular magnets are stacked alternately on the periphery of the supply cylinder member. The electrostatically charged liquid fuel cuts magnetic force lines of the magnets as the liquid fuel downwardly moves the stacked magnets. Accordingly, the liquid fuel is subjected to reformation due to action of magnetic force, thereby leading to complete combustion and suppression of black smoke emission during combustion.

The device may be further provided with a piston member in the supply cylinder member and a biasing member for urging the piston member toward the fuel inflow opening of the cylindrical casing. The piston member is movable in sliding contact with an inner surface of the supply cylinder member.

With this arrangement, the number of through holes of the supply cylinder member is adjusted in accordance with the flow rate of the liquid fuel by the positional change of the piston member in the supply cylinder member. Accordingly, the electrostatic charging owing to friction of the liquid fuel with the inner surface of the spiral channel can be secured under stabilized flow conditions. Thus, electrostatic charging can be performed to the liquid fuel in a stabilized manner.

The device may be further provided with a pulsation absorber made of a resilient material at a bottom of the cylindrical casing for absorbing fluctuation in fluid pressure of the liquid fuel.

With this arrangement, even if the pressure of the liquid fuel supplied into the cylindrical casing fluctuates in an extended period of time, the pulsation absorber resiliently deforms in conformance with the varying pressure or pulsation of the fuel. Consequently, the pulsation of the liquid fuel can be eliminated by the resilient pulsation absorber.

This application is based on patent application No. 2000-117392 filed in Japan on Apr. 19, 2000, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A black smoke emission suppressing device for suppressing generation of black smoke in combustion of a liquid fuel, comprising:

a vessel for allowing a liquid fuel to flow therethrough; and an electrostatic charger for electrostatically charging the liquid fuel, wherein the vessel includes:

a cylindrical casing formed with a fuel inflow opening in a center of an end thereof and a fuel outflow opening in a periphery thereof; and a supply cylinder member arranged in the cylindrical casing, the supply cylinder member having one end being opened, the other end being closed, and a plurality of through holes in a periphery thereof, the opened end being connected with the fuel inflow opening of the cylindrical casing to thereby allowing the liquid fuel to flow in the supply cylinder member;

the electrostatic charger including a charging cylinder coaxially placed on an outer periphery of the supply cylinder member, the charging cylinder being formed with a plurality of spiral channels extending in radial directions, inner openings of the plurality of spiral channels being respectively connected with the plurality of through holes of the supply cylinder member to thereby allow the liquid fuel to flow in the plurality of spiral channels and then flow out from outer openings of the plurality of spiral channels.

2. The device according to claim 1, wherein the charging cylinder includes a plurality of hollow disc members axially stacked on the outer periphery of the supply cylinder member, each disk member being formed a spiral groove for defining the spiral channel.

3. The device according to claim 2, wherein the electrostatic charger further includes a plurality of annular magnets placed between one disk member and another disk member.

4. The device according to claim 3, further comprising a piston member provided in the supply cylinder member, the piston member being movable in sliding contact with an inner surface of the supply cylinder member, and a biasing member for urging the piston member toward the fuel inflow opening of the cylindrical casing.

5. The device according to claim 2, wherein the disk member is made of a synthetic resin.

6. The device according to claim 1, further comprising a piston member provided in the supply cylinder member, the piston member being movable in sliding contact with an inner surface of the supply cylinder member, and a biasing member for urging the piston member toward the fuel inflow opening of the cylindrical casing.

7. The device according to claim 1, further comprising a pulsation absorber made of a resilient material at a bottom of the cylindrical casing for absorbing fluctuation in fluid pressure of the liquid fuel.

8. The device according to claim 1, wherein the charging cylinder is made of a synthetic resin.

* * * * *